US007798849B2

(12) United States Patent
Montena

(10) Patent No.: US 7,798,849 B2
(45) Date of Patent: Sep. 21, 2010

(54) CONNECTING ASSEMBLY FOR AN END OF A COAXIAL CABLE AND METHOD OF CONNECTING A COAXIAL CABLE TO A CONNECTOR

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/229,981

(22) Filed: Aug. 28, 2008

(65) Prior Publication Data

US 2010/0055978 A1 Mar. 4, 2010

(51) Int. Cl.
*H01R 9/05* (2006.01)

(52) U.S. Cl. ..... 439/583

(58) Field of Classification Search ..... 439/583, 439/584, 585, 586, 578, 579
See application file for complete search history.

(56) References Cited

U.S. PATENT DOCUMENTS

| | | | | | |
|---|---|---|---|---|---|
| 1,289,867 | A | * | 12/1918 | Moore | 411/329 |
| 2,412,409 | A | * | 12/1946 | Martin | 411/238 |
| 3,504,591 | A | * | 4/1970 | Christophersen | 411/6 |
| 3,686,623 | A | | 8/1972 | Nijman | |
| 4,046,052 | A | | 9/1977 | Nordstrom | |
| 4,749,251 | A | | 6/1988 | Moulin | |
| 5,041,004 | A | | 8/1991 | Waldorf | |
| 5,352,134 | A | | 10/1994 | Jacobsen et al. | |
| 6,252,170 | B1 | | 6/2001 | Korinek | |
| 6,491,546 | B1 | * | 12/2002 | Perry | 439/620.03 |
| 6,733,336 | B1 | * | 5/2004 | Montena et al. | 439/578 |
| 6,793,529 | B1 | | 9/2004 | Buenz | |
| 6,951,481 | B2 | | 10/2005 | Dykstra et al. | |
| 6,994,587 | B2 | * | 2/2006 | Buenz et al. | 439/578 |
| 7,014,501 | B2 | * | 3/2006 | Montena | 439/578 |
| 7,029,305 | B2 | | 4/2006 | Weidner | |
| 7,275,957 | B1 | * | 10/2007 | Wlos et al. | 439/583 |
| 2005/0176293 | A1 | * | 8/2005 | Khemakhem et al. | 439/578 |
| 2006/0240709 | A1 | * | 10/2006 | Montena et al. | 439/578 |

* cited by examiner

*Primary Examiner*—T C Patel
*Assistant Examiner*—Vladimir Imas
(74) *Attorney, Agent, or Firm*—Wood, Phillips, Katz, Clark & Mortimer

(57) ABSTRACT

A connecting assembly for an end of a coaxial cable and having a first element, that is turned around a first axis in a first rotational direction to progressively tighten the first element to a connector, and a housing. The connecting assembly further has: a) an axially elongated first groove in one component; and b) an axially elongated first finger on a second component that resides within the first groove with the connecting assembly in a first state. With the connecting assembly in the first state, turning of the housing in the first rotational direction causes the first finger to cause driving of the first element with a torque up to a predetermined torque. Continued turning of the housing with a torque exceeding the predetermined torque causes reconfiguration of the connecting assembly in a manner whereby the first finger moves circumferentially out of the first groove.

23 Claims, 6 Drawing Sheets

COAXIAL CABLE 14
AL
18
20
22
24
28
32
38
45
46
48
50
52
54
56
58
60
62
70
72
74
76
78
80
82
84
86
88

CONNECTING ASSEMBLY FOR AN END OF A COAXIAL CABLE AND METHOD OF CONNECTING A COAXIAL CABLE TO A CONNECTOR

BACKGROUND OF THE INVENTION

1. Field of the Invention

This invention relates to connecting assemblies for coaxial cable and, more particularly, to a connecting assembly that is secured to a connector by turning a housing around a rotational axis.

2. Background Art

The ends of coaxial cable are mechanically and electrically connected to other cables and/or ports for many different applications and in many different environments.

Such connections are commonly effected by: a) non-professionals, such as homeowners, on televisions and other electronic components; and b) professionals in the cable industry. These connections are made both inside homes and businesses as well as outside, where the connections are exposed to environmental conditions.

One common form of connecting assembly incorporates a threaded element that is turned around a rotational axis to progressively tighten the element to a connector. Connectors of this type, regardless of their design and construction, are generally susceptible to being overtightened. Overtightening can cause a number of problems.

Overtightening may make it difficult to loosen threadably joined elements in the event that the cable end is to be released. Overtightening may also cause a mechanical and/or electrical failure of the connecting assembly or, more significantly, damage to a component to which the cable end is connected.

The latter problem is particularly a concern with connecting assemblies that are made for internal use. These connecting assemblies need not incorporate sealing components to avoid ingress of moisture and other foreign material that may compromise signal transmission and potentially affect a connection, as by causing corrosion between cooperating metal parts. Thus, it is possible to design connecting assemblies for interior use with a less robust construction. These connecting assemblies may be designed to be strictly hand operable without the need for tools, such as wrenches or pliers. As a consequence, these connecting assemblies may be more prone to failure in the event that they are overtightened during the assembly process.

Many different constructions for connecting assemblies have been devised to avoid overtightening of components on cable ends. The industry continues to seek out designs that reliably prevent overtightening without creating complicated structures that account for high material and/or manufacturing costs that must be passed on to the consumer.

SUMMARY OF THE INVENTION

In one form, the invention is directed to a connecting assembly for an end of a coaxial cable. The connecting assembly has a first element that is turned around a first axis in a first rotational direction to progressively tighten the first element to a connector. A housing has an exposed surface that can be engaged by a user and turned around the first axis. The connecting assembly further consists of: a) an axially elongated first groove in one component; and b) an axially elongated first finger on a second component that resides within the first groove with the connecting assembly in a first state. With the connecting assembly in the first state, turning of the housing in the first rotational direction causes the first finger to cause driving of the first element in the first rotational direction with a torque up to a predetermined torque. Continued turning of the housing in the first rotational direction with a torque exceeding the predetermined torque causes reconfiguration of the connecting assembly in a manner whereby: i) the first finger moves circumferentially out of the first groove; and ii) the housing moves in the first rotational direction a first circumferential distance without causing movement of the first element a corresponding first circumferential distance.

In one form, the first element has threads extending around the first axis.

In one form, the first element has an axial extent and the first groove and first finger co-extend and interact over a majority of the axial extent of the first element.

In one form, the first element has a radially outwardly facing peripheral surface, that extends around the first axis and bounds the first groove, and at least one of the peripheral surface on the first element and first finger is reconfigured to allow the first finger to move circumferentially out of the first groove with the connecting assembly in the first state and a torque applied to the housing that exceeds the predetermined torque.

In one form, the first groove is on one of the first element and housing and the first finger is on the other of the first element and housing.

In one form, the connecting assembly further consists of: a) an axially elongated second groove in the one component; and b) an axially elongated second finger on the second component that resides within the second groove with the connecting assembly in the first state and the first finger residing within the first groove. The second finger and second groove cooperate in a manner substantially the same as the first finger cooperates with the first groove.

In one form, the housing has an axially opening receptacle within which the first element can be axially press fit to place the housing and first element in assembled relationship.

In one form, at least part of the exposed surface and one of the first finger and first groove are formed as one piece.

In one form, the one piece is formed by a molding process.

In one form, the first finger is on the housing and the housing has a body with a portion defining the first finger that is one of: a) press fit to the body; and b) co-molded with the body.

In one form, the first finger is reconfigured by being deformed primarily by radial material compression to allow the first finger to move circumferentially out of the first groove with the connecting assembly in the first state and a torque applied to the housing that exceeds the predetermined torque.

In one form, the exposed surface of the housing is contoured to facilitate hand grasping and turning of the housing by a user around the first axis.

In one form, the first finger is cantilever mounted to project in an axial line and the first finger is reconfigured by deflecting radially to allow the first finger to move circumferentially out of the first groove.

In one form, the first finger has a circumferential surface that is one of: a) convexly curved; and b) defined by separate flat surfaces meeting at an axially extending apex line.

In one form, the first groove is bounded by a surface that is complementary in shape to the circumferential surface of the first finger.

In one form, the connecting assembly is provided in combination with a coaxial cable that is mechanically and electrically coupled to the connecting assembly.

In one form, the connecting assembly is provided in combination with a connector to which the coaxial cable is mechanically and electrically coupled through the connecting assembly.

The invention is further directed to a connecting assembly for an end of a coaxial cable having a first internally threaded element that is turned around a first axis in a first rotational direction to progressively threadably tighten the first element to a connector. A housing has an exposed surface that can be engaged by a user and turned around the first axis. An axially elongated first groove is provided in one of the first element and housing. An axially elongated first finger is provided on the other of the first element and housing. The first finger resides within the first groove with the connecting assembly in a first state. With the connecting assembly in the first state, turning of the housing in the first rotational direction causes the first finger within the first groove to drive the first element in the first rotational direction with a torque up to a predetermined torque. Continued turning of the housing in the first rotational direction with a torque exceeding the predetermined torque causes reconfiguration of at least one of the first finger and surface bounding the first groove, whereby: i) the first finger moves circumferentially out of the first groove; and ii) the housing moves in the first rotational direction a first circumferential distance without causing movement of the first element a corresponding first circumferential distance.

In one form, the first element has an axial extent and the first groove and first finger co-extend and interact over a majority of the axial extent of the first element.

In one form, the first finger is reconfigured by being deformed primarily by radial material compression to allow the first finger to move circumferentially out of the first groove with the connecting assembly in the first state and a torque applied to the housing that exceeds the predetermined torque.

In one form, the first finger is cantilever mounted to project in an axial line and the first finger is configured by deflecting radially to allow the first finger to move circumferentially out of the first groove.

In one form, the first finger has a circumferential surface that is one of: a) convexly curved; and b) defined by separate flat surfaces meeting at an axially extending apex line.

In one form, the invention is directed to a connecting assembly for an end of a coaxial cable. The connecting assembly has a first element that is turned around a first axis in a first rotational direction to progressively tighten the first element to a connector. A housing has an exposed surface that can be engaged by a user and turned around the first axis. Cooperating groove and finger structures are provided on the first element and housing for: a) causing the first element to follow movement of the housing with the housing turned around the first axis with a torque up to a predetermined torque; and b) allowing the housing to move circumferentially relative to the first element with the housing turned around the first axis with a torque exceeding the predetermined torque.

The invention is further directed to a method of connecting a coaxial cable to a connector. The method includes the steps of: a) providing a connecting assembly having: a first element with threads; a housing; an axially elongated first groove on one of the first element and housing; and an axially elongated first finger on the other of the first element and housing; b) connecting an end of a coaxial cable to the connecting assembly; c) engaging the threads on the first element with threads on the connector; d) placing the connecting assembly in a first state wherein the first finger resides in the first groove; e) turning the housing in a first rotational direction around the first axis and thereby causing the first finger to drive the first element in the first rotational direction around the first axis with the connecting assembly maintained in the first state until a predetermined torque is applied to the housing, that threadably tightens the housing on the connector; and f) after applying the predetermined torque to the housing, increasing the torque applied to the housing to above the predetermined torque and thereby causing the connecting assembly to be reconfigured so that the first finger moves circumferentially out of the first groove.

The invention is further directed to a connecting assembly for a coaxial cable. The connecting assembly has a threaded element with a first axis that is movable by rotation in a first direction. The threaded element has an internal passageway with internal threads and an outer surface having a first groove. The connecting assembly further consists of a housing with a first surface configured to be engaged by a user for rotation about the first axis. The housing has an internal passageway at one end with an axial engagement portion for engaging the first groove. Turning the housing in the first direction causes the axial engagement portion to engage the first groove to cause the threaded element to move in the first direction with a predetermined torque. Continued turning of the housing in the first direction with a torque exceeding the predetermined torque causes the engagement portion to rotatably move out of the first groove.

DETAILED DESCRIPTION OF THE DRAWINGS

Figure 1:
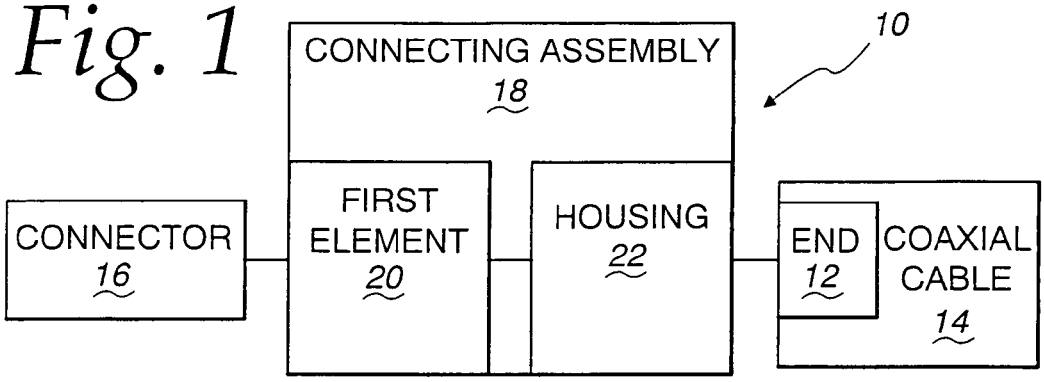
FIG. 1 is a schematic representation of a system, including a connecting assembly according to the present invention, to which a coaxial cable end is connected, and which is operatively coupled to a connector.

In FIG. 1, a system is shown at 10 through which an end 12 of a coaxial cable 14 is mechanically and electrically coupled to a connector 16. This connection is effected through a connecting assembly 18, consisting of a first element 20 that is turned around a first axis in a first rotational direction to progressively tighten the first element 20 to the connector 16, to thereby establish and maintain an electrical and mechanical connection thereat. The connecting assembly 18 further includes a housing 22 that can likewise be turned around the first axis.

Figure 2:
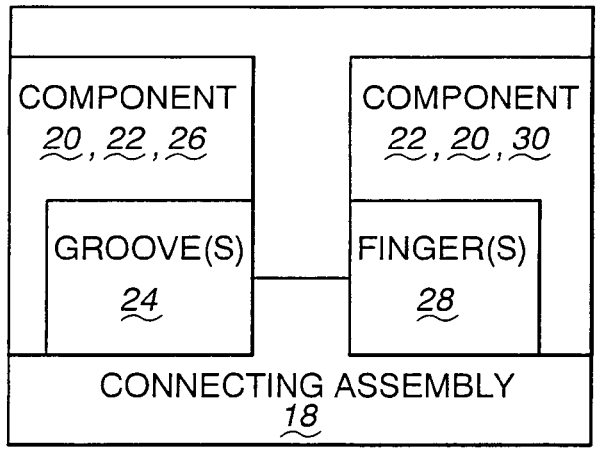
FIG. 2 is a schematic representation of the connecting assembly in FIG. 1.

As shown in FIG. 2, the connecting assembly 18 further has at least one axially elongated groove 24, on a component thereof, that may be the first element 20, the housing 22, or another component 26. The connecting assembly 18 further includes at least one axially elongated finger 28, on a component thereof, that may be the housing 22, first element 20, or another component 30. With the connecting assembly 18 in a first state, the finger(s) 28 resides within the groove(s) 24.

With the connecting assembly 18 in the first state, turning of the housing 22 in the first rotational direction around the first axis causes the finger 28 to cause driving of the first element 20 in the first rotational direction with a torque up to a predetermined torque.

Continued turning of the housing 22 in the first rotational direction, with a torque exceeding the predetermined torque, causes reconfiguration of the connecting assembly 18 in a manner whereby: i) the finger 28 moves circumferentially out of the groove 24; and ii) the housing 22 moves in the first rotational direction a first circumferential distance without causing movement of the first element 20 a corresponding first circumferential distance. This "slippage" prevents inadvertent, and potentially detrimental, overtightening of the first element 20. The connecting assembly 18 is designed so that the predetermined torque is one at which there is adequate tightening of the first element 20 to the connector 16, without overtightening.

The system 10 is shown in schematic form in FIGS. 1 and 2 since virtually a limitless number of variations in the components are contemplated without departing from the inventive concepts. For example, the first element 20 and connector 16 may have cooperating threads that allow tightening by relative rotation of the first element 20 and connector 16 about the first axis. Alternatively, a bayonet-type connection might be used wherein the overtightening feature prevents damage of components resulting from turning with an excessive torque beyond what is contemplated by its design. Virtually any type of connection that requires relative turning of elements around an axis is encompassed by the invention.

Figure 3:
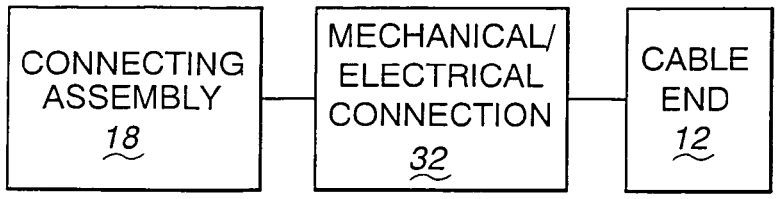
FIG. 3 is a schematic representation of a mechanical/electrical connection between the coaxial cable end and connecting assembly.
Figure 4:
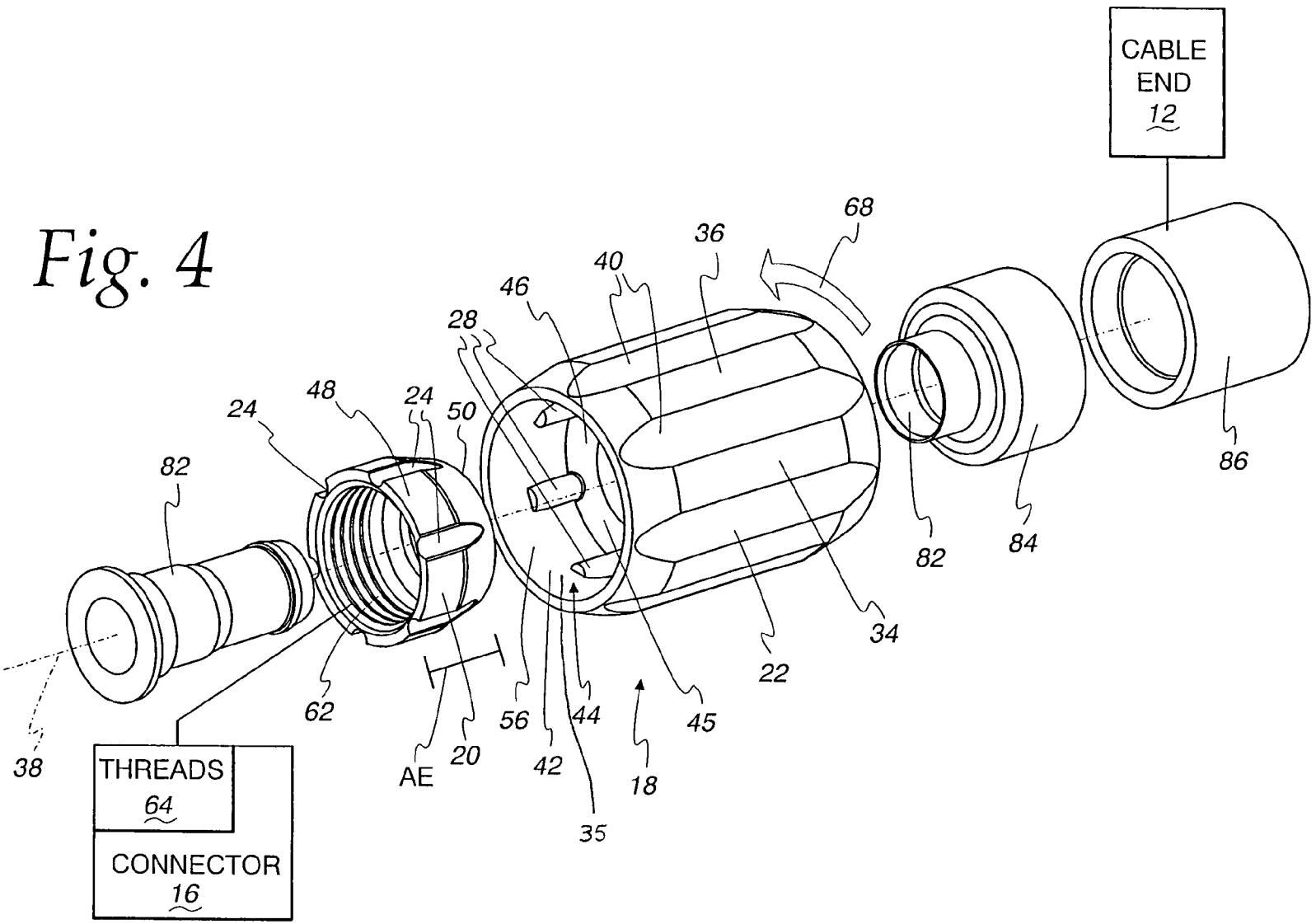
FIG. 4 is an exploded perspective view of one form of connecting assembly, as in FIGS. 1-3, operatively coupled to a connector and with one form of mechanical/electrical connection at the cable end.

As shown in FIG. 3, the precise manner of mechanically and/or electrically connecting the coaxial cable end 12 to the connecting assembly 18 is not critical to the present invention. In FIG. 3, a mechanical/electrical connection is shown schematically at 32 between the cable end 12 and connecting assembly 18. Many different forms of such connection 32 are currently available and are contemplated by the present invention.

As depicted in FIG. 2, the invention contemplates that the connecting assembly 18 might provide for a direct interaction between the groove(s) 24 and finger(s) 28 on the first element 20 and housing 22. Alternatively, there may be one or more intermediate components upon which the groove(s) 24 and finger(s) 28 are provided so that there is an indirect link between the first element 20 and housing 22. While the direct link between these components is shown in specific, preferred embodiments discussed hereinbelow, the invention contemplates one or more components that may be interacted between the first element 20 and housing 22, with the cooperating groove(s) 24 and finger(s) 28 being potentially on different interacting components.

Referring now to FIGS. 4-8, one specific form of the invention, as depicted schematically in FIGS. 1-3, is shown. The connecting assembly 18 consists of the first element 20 and housing 22. The housing 22 has a generally cylindrical body 34 bounding an internal passageway 35 and with an exposed, peripheral outer surface 36. The outer surface 36 is contoured to facilitate hand grasping and turning of the housing 22 by a user around the first axis 38. In this embodiment, the surface 36 has a plurality of circumferentially spaced, axially extending, grooves 40 that produce a knurled configuration that is conveniently hand graspable. The overall geometry of the housing 22 and the knurling facilitate application of a substantial turning forces upon the housing 22 by the user through his/her fingers. However, tightening with a tool, such as a wrench, is also contemplated. For this purpose, flats, producing a polygonal shape to be engaged by a wrench, may be incorporated.

Figures 6, 7, 8:
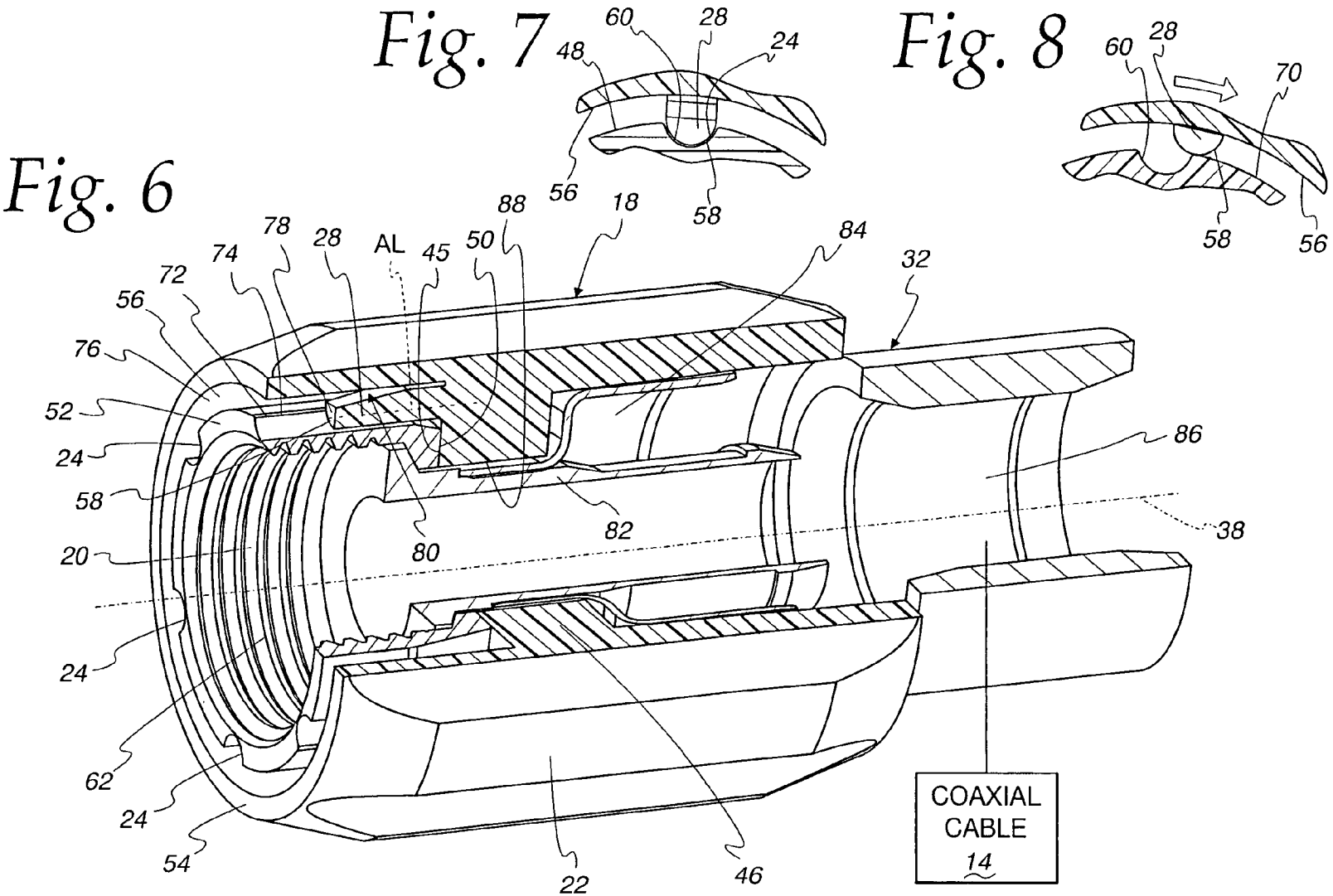
FIG. 6 is a view as in FIG. 5 wherein portions of the first element and housing are broken away.
FIG. 7 is a fragmentary, cross-sectional view, taken along line 7-7 of FIG. 5, of a cooperating finger and groove on the housing and first element, respectively, as shown in FIGS. 5 and 6, with the connecting assembly in a first state.
FIG. 8 is a view as in FIG. 7, wherein the housing is turned from the FIG. 7 position relative to the first element around the axis of the connecting assembly.

The body 34 has a stepped through bore 42 defining an axially opening receptacle 44 bounded by an axially facing, annular surface 45 on a base wall 46. The receptacle 44 is configured to be complementary to the shape of a radially outwardly facing, peripheral surface 48 on the first element 20. With this arrangement, the first element 20 can be axially press fit into the housing receptacle 44. More particularly, the first element 20 and housing 22 can initially be axially aligned in spaced relationship, as in FIG. 4, and thereafter moved axially towards each other until the assembled relationship shown in FIG. 6 is established. With the first element 20 and housing 22 in assembled relationship, an axial end surface 50 on the first element 20 abuts to the base wall surface 45. In this position, the axially opposite end 52 on the first element 20 is approximately flush, in an axial direction, with the axial end 54 of the housing 22.

While the invention contemplates that only a single groove 24 and finger 28 are required, in the embodiment shown, a plurality of, and in this case six, grooves 24 and fingers 28 are provided, respectively around the outer periphery of the first element 20 and around the inner periphery of a wall 56 on the housing 22. The housing internal passageway 35, at one axial end of the housing 22, defines an axial engagement portion for engaging at least one groove 24. While the engagement portion might vary in configuration, at least one groove-engaging structure is contemplated. In this embodiment, six grooves 24 and fingers 28 are equidistantly spaced around the first axis 38 so that the grooves 24 and fingers 28 can be circumferentially aligned in pairs preparatory to axially press fitting the first element 28, so as to place the housing 22 and first element 20 in the aforementioned assembled relationship, as depicted in FIG. 6. As this occurs, each finger 28 slides into a circumferentially aligned groove 24 to be axially co-extensive over a substantial distance.

To facilitate introduction of the first element 20 into the receptacle 44, the surface 48 tapers in diameter axially toward the end surface 50. This facilitates guided centering of the first element 20 within the receptacle 44, potentially with the first element 20 and housing 22 initially slightly axially misaligned.

In this embodiment, the first element 20 has an axial extent AE. With the first element 20 and housing 22 in assembled relationship, each of the grooves 24 and fingers 28, cooperating therewith, co-extend and interact over a majority, and potentially all, of the axial extent of the first element 20. All grooves 24 and fingers 28 are preferably the same in configuration and cooperate in substantially the same manner. This is not, however, required.

As best seen in FIG. 6, each of the fingers 28 is cantilever mounted to the base wall 46 at one axial end of the fingers 28 to project in an axial line AL. Each finger 28 has a circumferential surface 58 that is convexly curved. Portions 60 of the peripheral surface 48, that bound the grooves 24, have concave shapes that are complementary and nominally matched in shape to the shapes of the surfaces 58 on the fingers 28. That is, the grooves 24 have shapes that are complementary to, and substantially the same as, the circumferential surfaces 58 on the fingers 28.

Figure 5:
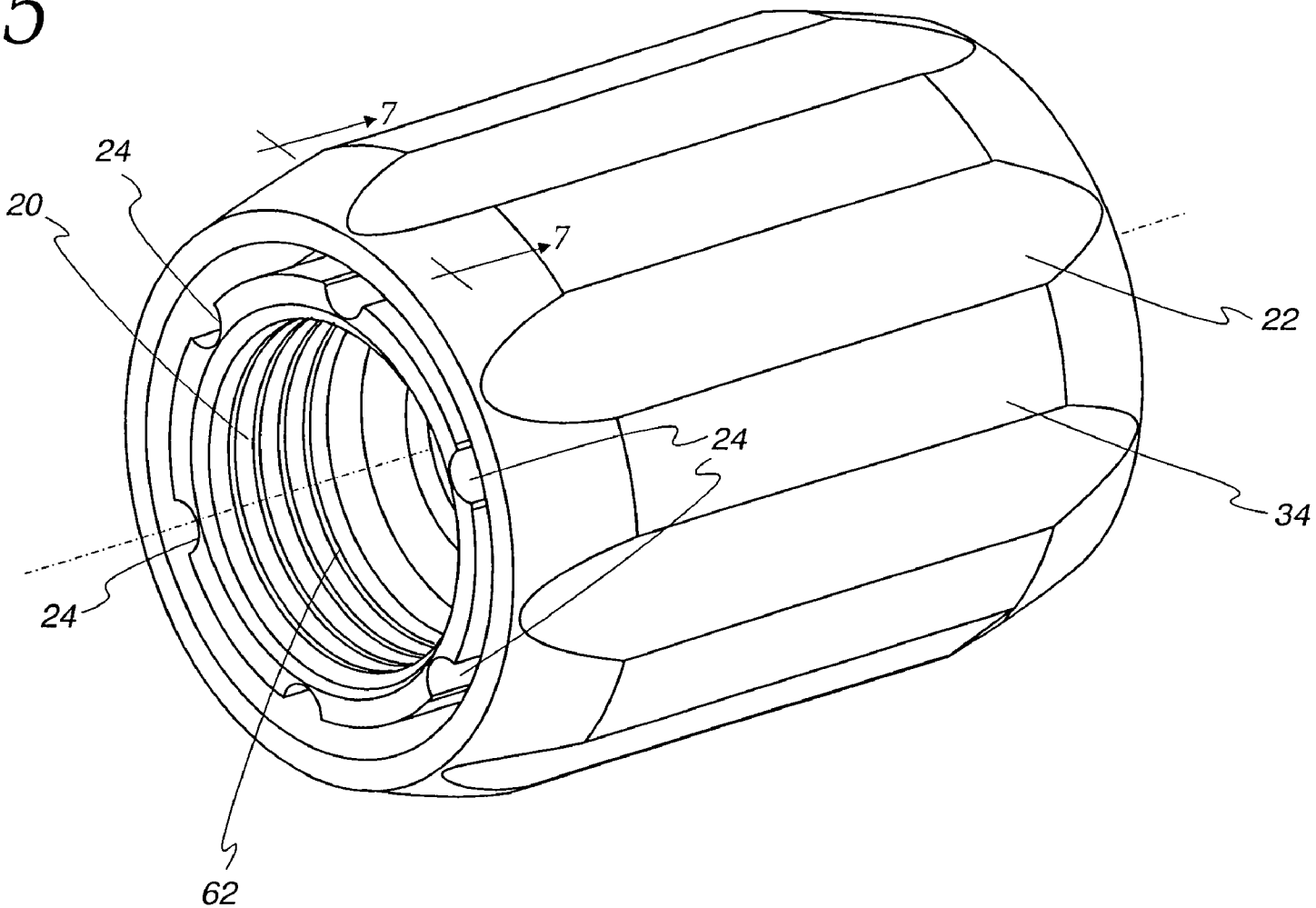
FIG. 5 is an enlarged, perspective view of the connecting assembly in FIG. 4 with a first element and housing thereon in assembled relationship.

With the connecting assembly in a first state, as shown in FIGS. 5 and 6, the fingers 28 reside, one each, in a groove 24. By grasping the housing 22 with the connecting assembly 18 in the first state, and turning the housing 22 around the first axis, the finger surfaces 58 interact with the surface portions 60 within the grooves 24, thereby driving the first element 20 to follow movement of the housing 22. Through this action, internal threads 62, extending on an internal passageway defined by the first element 20 around the axis 38, and cooperating threads 64 on the connector 16, can be relatively moved to progressively tighten the first element 20 to the connector 16.

Turning of the housing 22 in a tightening, first rotational direction around the first axis 38, as indicated by the arrow 68, can be carried out to apply a predetermined torque through the housing 22 to the first element 20, as dictated by the component configuration, materials of constructions, etc.

Continued turning of the housing 22 in the first rotational direction, with a torque exceeding the designed predetermined torque, causes the fingers 28 to be cammed radially outwardly, as a result of their interaction with the surface portions 60, as shown in FIG. 8. Eventually, the fingers 28 are reconfigured by radially deflecting movement to the point that they move out of the grooves 24, whereupon they slide against surface portions 70 between grooves 24, without causing any further significant turning of the first element 20. This slippage prevents overtightening. Continued turning causes the fingers 28 to seat in circumferentially adjacent grooves 24, whereupon the above interaction is repeated as a turning torque, exceeding the predetermined torque, is continuously applied.

While the fingers 28 reconfigure primarily by radial deflection, the invention contemplates that the fingers 28 and/or the surface 48 may be made from a material that reconfigures/deforms by material compression to make possible movement of the fingers 28 to outside of the grooves 24. The parts may interact, through a captive squeezing action, to permit the requisite reconfiguration.

It should also be noted, as is intended to be shown in FIG. 2, that the fingers 28 could be provided on the first element 20, with the grooves 24 provided on the housing 22. The grooves 24 and fingers 28 could interact in like fashion in this reversed arrangement. The complementary shapes of the grooves 24 and fingers 28 make this interaction possible with each variation.

To further facilitate movement of the fingers 28 to outside of the grooves 24, and avoid hangup, a narrow width chamfer 72 can be provided on the corners 74 where the surface portions 60, 70 meet.

The fingers 28 may be mold formed as one piece with at least a part of the body 34 defining the exposed surface 36. In a preferred form, the entire housing 22 is formed as one piece, as from a non-metal, plastic material. The grooves 24, if provided on the body 34, could be formed with this one piece.

As seen in FIGS. 6 and 7, the fingers 28 are radially spaced from the radially inwardly facing surface 76 of the wall 56. Since the fingers 28 will deflect radially a greater amount near their free ends 78, a radial gap at 80 between each finger 28 and the surface 76 increases progressively towards its free end 78. This arrangement avoids binding between the fingers 28 and surface 76 that might arrest deflection before the fingers 28 are adequately radially repositioned and is designed to permit the requisite degree of radial deflection before the free ends 78 abut to the wall 56, as seen in FIG. 8.

In this embodiment, the mechanical/electrical connection 32 consists of three separate components 82, 84, 86. The component 82 is directed axially through a reduced diameter wall portion 88 and engaged with the components 84, 86 through an arrangement which captively embraces the base wall 46.

Figure 9:
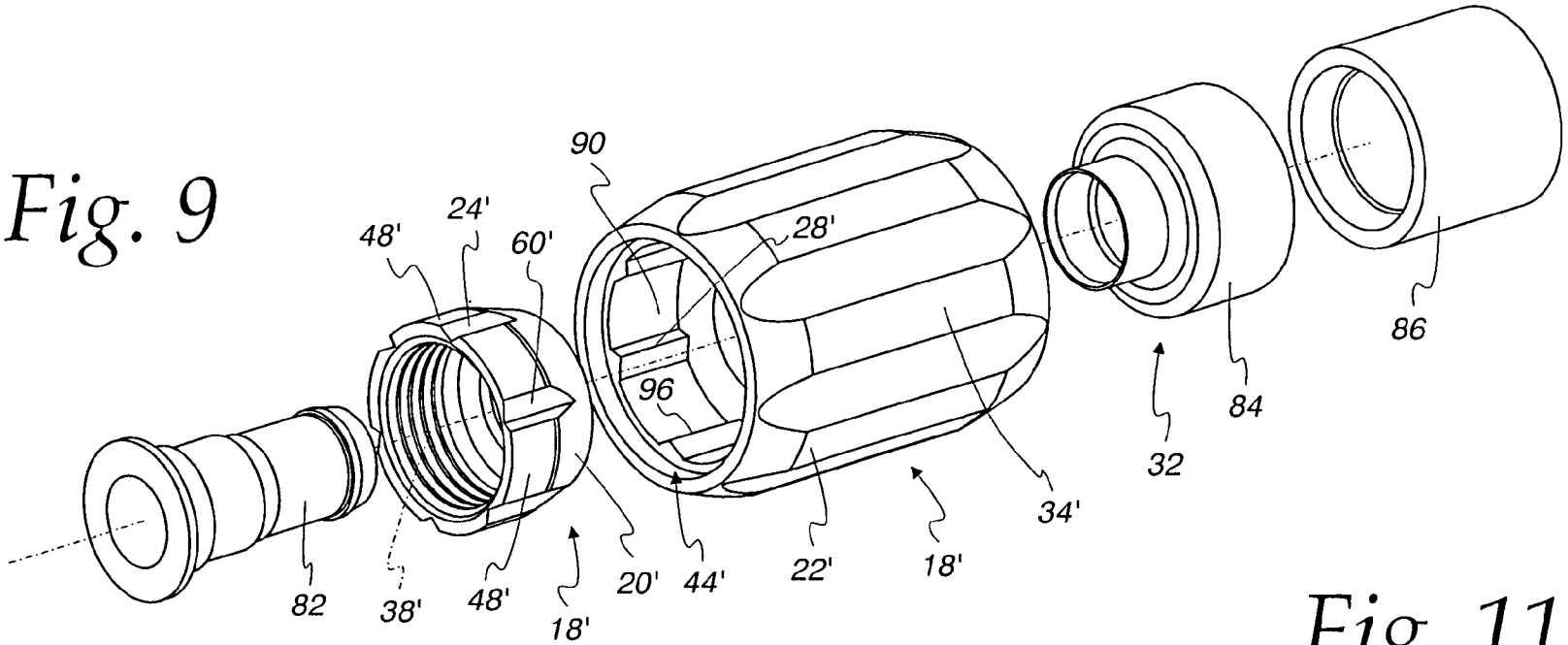
FIG. 9 is a view as in FIG. 4 of a modified form of connecting assembly, according to the invention.
Figure 11:
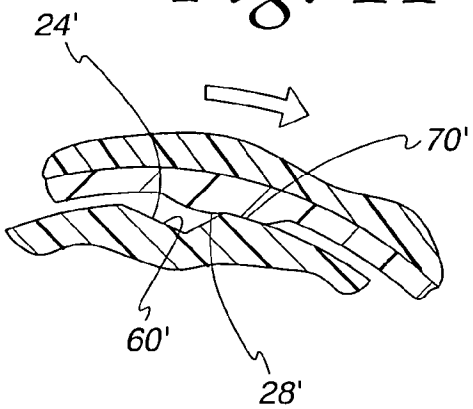
FIG. 11 is a view of the connecting assembly, as shown in FIG. 9, and corresponding to that in FIG. 8.
Figure 10:
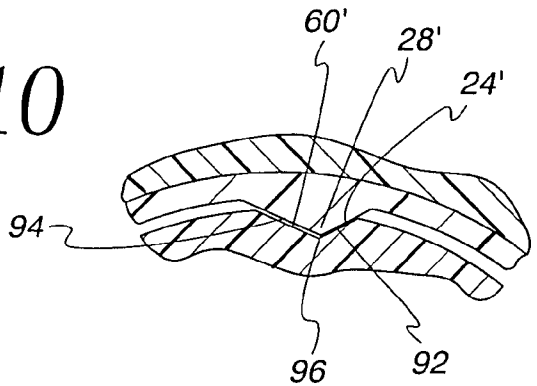
FIG. 10 is an enlarged, fragmentary, cross-sectional view of the connecting assembly in FIG. 9, and corresponding to that in FIG. 7.

In FIGS. 9-11, a modified form of the invention is shown. The connecting assembly 18' differs from the connecting assembly 18 primarily by reason of a difference in configuration of the grooves 24' and fingers 28'. The grooves 24' are provided on a corresponding first element 20' with the fingers 28' formed as ridges on a corresponding housing 22'.

The fingers 28' are defined on a ring-shaped portion 90 of the housing 22' that is either press fit within a receptacle 44' defined by a body 34', or co-molded therewith.

The grooves 24' and fingers 28' have the same axial extent as the corresponding grooves 24 and fingers 28. However, the fingers 28' are defined by separate, transverse, flat surfaces 92, 94 that meet at an axially extending apex line 96.

The first element 20' has a peripheral surface 48' with surface portions 60' bounding the grooves 24' that are complementary, and nominally matched, in shape to the shapes of the fingers 28'.

As seen in sequence in FIGS. 10 and 11, as the housing 22' is turned about the first axis 38', from the FIG. 10 position wherein the connecting assembly 18' is in a first state, the fingers 28' are reconfigured by primarily radial material compression, as shown in FIG. 11. That is, the fingers 28' become radially squeezed/compacted to allow circumferential movement thereof to outside of the grooves 24' to circumferentially coincide with surface portions 70' between adjacent grooves 24'. The fingers 28' can thus "slip" and thereby move slidingly against and relative to the surface portions 70' without effecting any significant turning of the first element 20'.

Accordingly, with this arrangement, overtightening is avoided. The component shapes, relative dimensions and materials of construction together determine the predetermined torque applied to the housing 22' at which the housing 22' will circumferentially slip, i.e. turn, relative to the first element 20'.

The material defining the surface portion 48' on the first element 20' can also be made to be compressible to facilitate movement of the fingers 28' to outside of the grooves 24'.

The connection 32' consists of the same three components 82, 84, 86 making up the connection 32.

In both embodiments, the grooves 24, 24' and fingers 28, 28', respectively on the elements 20, 20' and 22, 22', define cooperating means for: a) causing the first elements 20, 20' to follow movement of the housings 22, 22', with the housings 22, 22' turned around their first axis 38, 38' with a torque up to a predetermined torque; and b) allowing the housings 22, 22' to move circumferentially relative to the first elements 20, 20' with the housings 22, 22' turned around the first axis 38, 38' with a torque exceeding the predetermined torque.

As noted above, the invention contemplates many variations from the specific embodiments described herein. For example, there may be a single groove on one component and multiple fingers on a cooperating component that serially move into the groove as the housing is continuously turned. Likewise, a single finger may cooperate with multiple grooves.

The internal/external relationship of threads can be reversed on the first elements and connectors.

Based upon the teachings herein, one skilled in the art has the ability to select different finger and groove shapes, materials of construction, relative component sizes, etc. to design into each connecting assembly a desired slipping torque, that is appropriate to system requirements.

It is also noted that the specific embodiments are shown without any specific sealing structure, such as strategically placed gaskets, O-rings, etc. The invention contemplates that such sealing structures could be incorporated for exterior applications.

The potential advantages afforded by the "interior" design may be significant. As the pre-made jumper business has increased significantly over the last several years, the total volume of connecting assemblies allocated for use on jumpers has achieved a level which allows a jumper-specific connecting assembly to be made cost effectively. This allows: a) focus on manufacturing and assembly issues since the designs are unconstrained by field installation considerations; and b) cost reduction by eliminating certain features and high performance design features, due to the contemplated indoor use of these jumpers. For instance, the connecting assemblies need not have a universal fit over a broad range of cables. They need not form a moisture-proof seal on cables, nor need they apply easily to these cables under extreme weather conditions without tool or power assistance, since the connecting assemblies will be attached only to a narrow selection of cables on a factory assembly line for indoor use by consumers.

The O-rings and other sealing components or features for these designs, while capable of being incorporated, are unnecessary. Likewise length may be significantly reduced, primarily because there is no longer a need to ensure that stray cable braid ends remain well within the connecting assembly and well outside the compression area. Because the connecting assemblies will not be mishandled during assembly, and will generally be hand installed using low torque values (typically ⅓ of SCTE compliant outdoor use), connector components may be made of less expensive materials and manufactured by less costly methods. Stampings, die castings and injection moldings may replace lathe-turned brass. These advantages make the less robust connecting assemblies highly prone to failure upon being overtightened. The inventive design addresses this problem for these, as well as more sturdily constructed, designs.

The incorporation of a knurled nut, which forms the entirety of the external appearance, allows additional material to be removed from internal parts which otherwise might have to be more substantial to avoid: a) perception of lower quality; and b) poor aesthetics.

Figure 12:
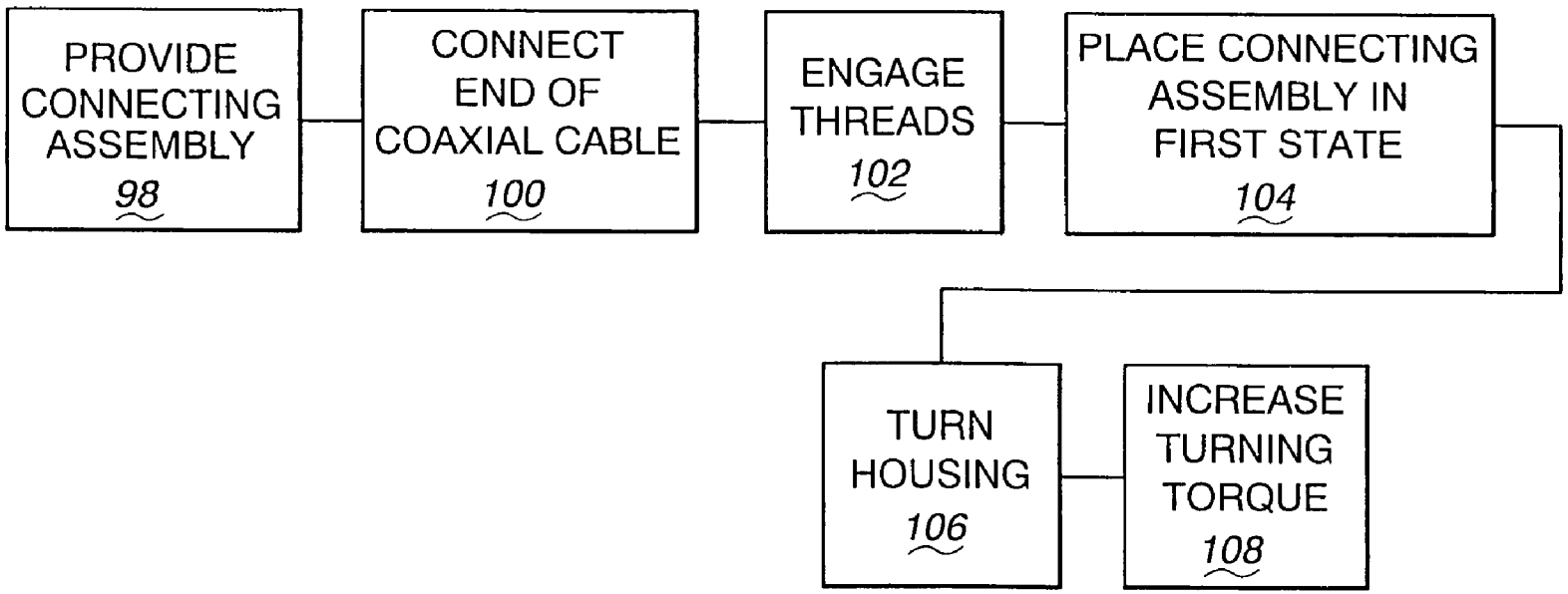
FIG. 12 is a flow diagram representation of a method of connecting a coaxial cable to a connector, according to the present invention.

As shown in flow diagram form in FIG. 12, the invention is also directed to a method of connecting a coaxial cable to a connector. As shown at block 98, the method includes the step of providing a connecting assembly having: a first element with threads; a housing; an axially elongated first groove on one of the first element and housing; and an axially elongated first finger on the other of the first element and housing.

As shown at block 100, an end of a coaxial cable is connected to the connecting assembly.

As shown at block 102, the threads of the first element are engaged with threads on the connector.

As shown at block 104, the connecting assembly is placed in a first state wherein the first finger resides in the first groove.

As shown at block 106, the housing is turned in a first rotational direction around a first axis and thereby causes the first finger to drive the first element in a first rotational direction around the first axis, with the connecting assembly maintained in the first state, until a predetermined torque is applied to the housing that adequately threadably tightens the housing on the connector.

As shown at block 108, after applying the predetermined torque to the housing, the torque is increased to above the predetermined torque, thereby causing the connecting assembly to be reconfigured so that the first finger moves circumferentially out of the first groove, as the housing turns around the first axis and relative to the first element, thereby avoiding inadvertent further, potentially detrimental, tightening of the first element.

The foregoing disclosure of specific embodiments is intended to be illustrative of the broad concepts comprehended by the invention.

The invention claimed is:

1. A connecting assembly for an end of a coaxial cable, the connecting assembly comprising:

a first element that is turned around a first axis in a first rotational direction to progressively tighten the first element to a connector;

a housing having an exposed surface that can be engaged by a user and turned around the first axis; and the connecting assembly further comprising: a) an axially elongated first groove in one component; and b) an axially elongated first finger on a second component that resides within the first groove with the connecting assembly in a first state, with the connecting assembly in the first state, turning of the housing in the first rotational direction causes the first finger to cause driving of the first element in the first rotational direction with a torque up to a predetermined torque, whereupon continued turning of the housing in the first rotational direction with a torque exceeding the predetermined torque causes reconfiguration of the connecting assembly in a manner whereby: i) the first finger moves circumferentially out of the first groove; and ii) the housing moves in the first rotational direction a first circumferential distance without causing movement of the first element a corresponding first circumferential distance, wherein the first finger is cantilever mounted to project in an axial line and the first finger is reconfigured by deflecting radially to allow the first finger to move circumferentially out of the first groove.

2. The connecting assembly for an end of a coaxial cable according to claim 1 wherein the first element has threads extending around the first axis.

3. The connecting assembly for an end of a coaxial cable according to claim 1 wherein the first element comprises a threaded body with an axial extent and the first groove and first finger co-extend and interact over a majority of the axial extent of the body on the first element.

4. The connecting assembly for an end of a coaxial cable according to claim 1 wherein the first groove is on one of the first element and housing and the first finger is on the other of the first element and housing.

5. The connecting assembly for an end of a coaxial cable according to claim 1 wherein the connecting assembly further comprises: a) an axially elongated second groove in the one component; and b) an axially elongated second finger on the second component that resides within the second groove with the connecting assembly in the first state and the first finger residing within the first groove, the second finger and second groove cooperating in a manner substantially the same as the first finger cooperates with the first groove.

6. The connecting assembly for an end of a coaxial cable according to claim 4 wherein the housing has an axially opening receptacle within which the first element can be axially press fit to place the housing and first element in assembled relationship.

7. The connecting assembly for an end of a coaxial cable according to claim 4 wherein at least part of the exposed surface and one of the first finger and first groove is formed as one piece.

8. The connecting assembly for an end of a coaxial cable according to claim 7 wherein the one piece is formed by a molding process.

9. The connecting assembly for an end of a coaxial cable according to claim 1 wherein the first finger is on the housing and the housing comprises a body with a portion defining the first finger that is one of: a) press fit to the body; and b) co-molded with the body.

10. The connecting assembly for an end of a coaxial cable according to claim 1 wherein the exposed surface of the housing is contoured to facilitate hand grasping and turning of the housing by a user around the first axis.

11. The connecting assembly for an end of a coaxial cable according to claim 1 wherein the first finger has a circumferential surface that is one of: a) convexly curved; and b) defined by separate flat surfaces meeting at an axially extending apex line.

12. The connecting assembly for an end of a coaxial cable according to claim 1 in combination with a coaxial cable that is mechanically and electrically coupled to the connecting assembly.

13. The connecting assembly for an end of a coaxial cable according to claim 12 in combination with a connector to which the coaxial cable is mechanically and electrically coupled through the connecting assembly.

14. The connecting assembly for an end of a coaxial cable according to claim 1 wherein the first finger is reconfigured by being deformed primarily by radial material compression to allow the first finger to move circumferentially out of the first groove with the connecting assembly in the first state and a torque applied to the housing that exceeds the predetermined torque.

15. A connecting assembly for an end of a coaxial cable, the connecting assembly comprising:

a first element that is turned around a first axis in a first rotational direction to progressively tighten the first element to a connector;

a housing having an exposed surface that can be engaged by a user and turned around the first axis; and the connecting assembly further comprising: a) an axially elongated first groove in one component; and b) an axially elongated first finger on a second component that resides within the first groove with the connecting assembly in a first state, with the connecting assembly in the first state, turning of the housing in the first rotational direction causes the first finger to cause driving of the first element in the first rotational direction with a torque up to a predetermined torque, whereupon continued turning of the housing in the first rotational direction with a torque exceeding the predetermined torque causes reconfiguration of the connecting assembly in a manner whereby: i) the first finger moves circumferentially out of the first groove; and ii) the housing moves in the first rotational direction a first circumferential distance without causing movement of the first element a corresponding first circumferential distance, wherein the first finger has a circumferential surface that is one of: a) convexly curved; and b) defined by separate flat surfaces meeting at an axially extending apex line, wherein the first groove is bounded by a surface that is complementary and nominally matched in shape to, and substantially the same as, a shape of the circumferential surface of the first finger.

16. The connecting assembly for an end of a coaxial cable according to claim 15 wherein the first finger is reconfigured by being deformed primarily by radial material compression to allow the first finger to move circumferentially out of the first groove with the connecting assembly in the first state and a torque applied to the housing that exceeds the predetermined torque.

17. A connecting assembly for an end of a coaxial cable, the connecting assembly comprising:

a first internally threaded element that is turned around a first axis in a first rotational direction to progressively threadably tighten the first element to a connector;

a housing having an exposed surface that can be engaged by a user and turned around the first axis;

an axially elongated first groove in one of the first element and housing; and an axially elongated first finger on the other of the first element and housing, the first finger having a circumferential surface residing within the first groove with the connecting assembly in a first state, the circumferential surface of the first finger and first groove having shapes as viewed in cross section taken transversely to the first axis that are complementary and substantially the same, with the connecting assembly in the first state, turning of the housing in the first rotational direction causes the first finger within the first groove to drive the first element in the first rotational direction with a torque up to a predetermined torque, whereupon continued turning of the housing in the first rotational direction with a torque exceeding the predetermined torque causes reconfiguration of at least one of the first finger and surface bounding the first groove whereby: i) the first finger moves circumferentially out of the first groove; and ii) the housing moves in the first rotational direction a first circumferential distance without causing movement of the first element a corresponding first circumferential distance.

18. The connecting assembly for an end of a coaxial cable according to claim 17 wherein the first element comprises a threaded body with an axial extent and the first groove and first finger co-extend and interact over a majority of the axial extent of the body on the first element.

19. The connecting assembly for an end of a coaxial cable according to claim 17 wherein the first finger is reconfigured by being deformed primarily by radial material compression to allow the first finger to move circumferentially out of the first groove with the connecting assembly in the first state and a torque applied to the housing that exceeds the predetermined torque.

20. The connecting assembly for an end of a coaxial cable according to claim 17 wherein the first finger has axial ends and is cantilever mounted at only one axial end of the first finger to project in an axial line and the first finger is reconfigured by deflecting radially to allow the first finger to move circumferentially out of the first groove.

21. The connecting assembly for an end of a coaxial cable according to claim 17 wherein the first finger has a circumferential surface that is one of: a) convexly curved; and b) defined by separate flat surfaces meeting at an axially extending apex line.

22. A connecting assembly for a coaxial cable, the connecting assembly comprising:

a threaded element having a first axis for rotation in a first direction, the threaded element comprising:

an internal passageway having internal threads; and an outer surface having a first groove bounded by a surface; and a housing having a first surface configured to be engaged by a user for rotation about the first axis, the housing having a housing internal passageway, the housing internal passageway at one end having an axial engagement portion for engaging the first groove, whereby turning the housing in the first direction causes the axial engagement portion to engage the first groove to cause the threaded element to move in the first direction with a predetermined torque, whereupon continued turning of the housing in the first direction with a torque exceeding the predetermined torque causes the axial engagement portion to rotatably move out of the first groove, wherein at least one of the surface bounding the groove and the axial engagement portion is reconfigured by being deformed primarily by radial material compression to allow the axial engagement portion to rotatably move out of the first groove as an incident of the housing being turned with a torque exceeding the predetermined torque.

23. A connecting assembly for an end of a coaxial cable, the connecting assembly comprising:

a first element that is turned around a first axis in a first rotational direction to progressively tighten the first element to a connector;

a housing having an exposed surface that can be engaged by a user and turned around the first axis; and the connecting assembly further comprising: a) an axially elongated first groove in one component; and b) an axially elongated first finger on a second component that resides within the first groove with the connecting assembly in a first state, with the connecting assembly in the first state, turning of the housing in the first rotational direction causes the first finger to cause driving of the first element in the first rotational direction with a torque up to a predetermined torque, whereupon continued turning of the housing in the first rotational direction with a torque exceeding the predetermined torque causes reconfiguration of the connecting assembly in a manner whereby: i) the first finger moves circumferentially out of the first groove; and ii) the housing moves in the first rotational direction a first circumferential distance without causing movement of the first element a corresponding first circumferential distance, wherein the second component has a body and the first finger has axially spaced first and second ends and is cantilever mounted to the body by connection of the first end of the finger to the body so that the finger projects in an axial direction and the second end of the first finger can bend relative to the first end of the first finger in a radial direction to move into and out of the first groove.

* * * * *